US008448314B2

(12) United States Patent
Brandtner

(10) Patent No.: US 8,448,314 B2
(45) Date of Patent: May 28, 2013

(54) SOFA SLEEPER INSTALLATION AND SYSTEM

(75) Inventor: Timothy A. Brandtner, Ettrick, WI (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 359 days.

(21) Appl. No.: 12/857,545

(22) Filed: Aug. 16, 2010

(65) Prior Publication Data

US 2011/0035875 A1 Feb. 17, 2011

Related U.S. Application Data

(60) Provisional application No. 61/234,204, filed on Aug. 14, 2009.

(51) Int. Cl.
*B23P 11/00* (2006.01)

(52) U.S. Cl.
USPC ..... 29/91; 29/434; 29/428; 29/425; 5/12.1

(58) Field of Classification Search
USPC ..... 5/12.1, 13, 18.1, 37.1; 29/428, 91.1, 29/425, 434
See application file for complete search history.

(56) References Cited

U.S. PATENT DOCUMENTS

| | | | | |
|---|---|---|---|---|
| 5,423,596 | A * | 6/1995 | Laughlin et al. | 297/440.1 |
| 5,551,757 | A * | 9/1996 | Glover | 297/440.23 |
| 5,678,897 | A * | 10/1997 | Prestia | 297/440.15 |
| 6,839,950 | B2 * | 1/2005 | Guillot | 29/428 |
| 7,744,162 | B2 * | 6/2010 | Griggs, Jr. | 297/440.14 |
| 2006/0179566 | A1 | 8/2006 | James et al. | |
| 2008/0066227 | A1 | 3/2008 | James et al. | |
| 2008/0098518 | A1 | 5/2008 | Arft | |

OTHER PUBLICATIONS

Description of Conventional Sofa Sleeper Install, before 2009.

* cited by examiner

*Primary Examiner* — Frederick Conley
(74) *Attorney, Agent, or Firm* — Christensen Fonder, P.A.

(57) ABSTRACT

Improved methods and apparatuses relating to installation of a sleeper mechanism into a frame of a sofa sleeper are disclosed. In one embodiment, initially the frame is aligned such that an open bottom portion of the frame is upright and facing outwardly. The sleeper mechanism is then advanced towards the open bottom portion and hook apertures on the brackets are engaged with upper fasteners on the frame. The sleeper mechanism is then swung inwardly towards the top portion of the frame until notches on the bracket are passed lower fasteners on the frame and then swung back towards the open bottom portion to engage the notches with the lower fasteners.

6 Claims, 5 Drawing Sheets

SOFA SLEEPER INSTALLATION AND SYSTEM

RELATED APPLICATION

This application claims the benefit of U.S. Provisional Application No. 61/234,204, filed Aug. 14, 2009, which is hereby fully incorporated herein by reference.

FIELD OF THE INVENTION

The present invention relates to sofa sleepers and more particularly to an improved method of installing a sleeper mechanism into a sofa sleeper.

BACKGROUND OF THE INVENTION

Sofa sleepers are popular with consumers because they can function both as a standard sofa and as a bed. A sleeper mechanism, essentially a foldable mattress supported by a sofa sleeper mechanism, can be folded within sofa frame underneath the sofa cushions to allow the sofa sleeper to be used as if it were a standard sofa. When the cushions are removed and the sleeper mechanism is extended out, the sofa sleeper can function more similar to a bed.

The sofa sleeper mechanisms of sofa sleepers are typically installed into the frame of the sofa sleeper along an assembly line. The frame typically being formed of wood or wood products fastened together to form a pair of sides, a back, and a lower base, the lower base being open on top and on bottom. The "sides" include a pair of side panel members that face the cavity to receive the sleeper mechanism. Typically, the sofa frame is "dressed" with fiber board, padding, and upholstery before the sleeper mechanism is installed. The sofa sleeper mechanisms have a pair of elongate horizontal brackets, one on each side of the sleeper mechanism upon which several linkages are connected. The sleeper mechanisms attach to the sofa frames exclusively or primarily by fasteners extending through the pair of brackets and into or through the sides of the frame. Each of the elongate horizontal brackets have a plurality of L-shaped slots extending downwardly from a top edge of the brackets. The lower leg of the L pointing towards the "head side" or top of the sleeper mechanism and mattress combination, that is they point toward the back of the sofa sleeper. Conventionally, the sleeper mechanism is positioned on a table and the sofa sleeper frame is lifted up and over the sleeper mechanism and is then lowered, by an individual on each end, down over the sleeper mechanism. Each end of the sofa frame maneuvered and adjusted to position studs or screws that are extending horizontally inward from each of the respective two side panel members down into the L-shaped slots of the elongate horizontal brackets that extend downwardly from the top edge of the bracket. Typically at least two studs, bolts or screws are extending from each side of the sofa frame that need to be guided into the slots extending from the top of the mechanism. The threaded fasteners are guided downward, by maneuvering the fully dressed sofa frame, and then are guided rearwardly in the lower leg of the L-shaped slots. The at least two studs, bolts, or screws are then tightened and additional wood screw type fasterners may be added through existing holes in the bracket into the side panel member. The sleeper frame with sleeper mechanism attached therein is moved to the next operation in the sofa assembly process.

Such assembly process demands at least two individuals to lift and maneuver the "fully dressed" sofa frame over the sleeper mechanism. Such sofa frame is typically much heavier than the sleeper mechanism. Thus, this type of assembly is awkward and inefficient as it is difficult to precisely maneuver the heavy fully dressed sofa frame so that the extending threaded members are guided into the L-shaped slots and then are guided rearwardly to finally seat at the end of the slot. Other than the workers forcing the threaded members into the end of the slot there is no assurance that the sofa mechanism will be properly seated therein. With the fasteners being inside the sofa and not readily accessible or viewable, such misalignment may go unnoticed and can lead to subsequent loosing of the overall sleeper mechanism to sofa frame attachment.

Moreover, the fasteners that extend from the side panel members are attached to downwardly extending slots on the horizontal brackets of the sleeper. If the fasteners securing the brackets to the sofa frame loosen, the mechanism can fall out of the sofa frame when the sleeper sofa is lifted by the consumer. If there is any shift forward of the threaded members with respect to the horizontal brackets the sleeper mechanism can fall within the sleeper mechanism cavity and can fall out of the sofa frame when lifted by the consumer.

Such an assembly above also dictates at least two people handling the sofa frame and sleeper mechanism install. A more reliable and efficient means of assembling sleeper mechanisms into sofa frames is needed.

It is possible to install such sleeper mechanisms with the sofa frame rotated 90 degrees backwards and with the open bottom of the unit facing outwardly. This is quite difficult in that conventional slots on the horizontal brackets of sleeper mechanisms extend from the top edge and go rearwardly (toward the users' head when the mechanism and mattress are open), the sleeper mechanism must be manually held upward to seat the threaded members in the slot while the threaded members are being secured. This also is awkward and increases the potential of the threaded fasteners not being properly seated in the end of the L-shaped or hook shaped slots. The sleeper generally must then be partially opened to secure the threaded fasterners in place, while the workers are bearing the weight of the sleeper mechanism, and to drive additional fasteners, typically screws, through the horizontal bracket (oriented vertically for this step) for additional support. The assembled sofa frame and sleeper then continue along the assembly line.

Although this process allows lifting of the relatively lighter sleeper mechanism compared to the sofa frame, there remains a need for a more efficient and less labor intensive method of installing a sleeper mechanism in a sofa sleeper.

SUMMARY OF THE INVENTION

An improved system and method for installing a sleeper mechanism into a frame of a sofa sleeper increases efficiency of installation and the safety of the finished product.

In an embodiment of the invention, the sofa frame is rotated backwardly so that it rests on its back and so that the open base of the frame is facing outwardly. The sofa frame has hanging support, such as threaded members, extending into a sleeper mechanism cavity. A sleeper mechanism with horizontal brackets on each end of the sleeper mechanism have slots or apertures, in said brackets, adapted to receive the threaded members by a simple horizontal placement motion to allow the sleeper mechanism to be inserted in the sleeper mechanism cavity and to be hung on the extending threaded members, whereby the weight of the sleeper member can be supported by the threaded members within the sleeper mechanism cavity during completion of the fastening of the horizontal brackets, rather than having the weight of the sleeper mechanism supported by the workers during such fastening.

A further feature and advantage of embodiments of the invention is that at least one of two "original" fasteners on each side of the sofa frame may be utilized to engage the horizontal bracket at a slot underneath or through a hole in the horizontal bracket such that the weight of the sleeper mechanism when the sofa sleeper is in the normal use position, is supported by said original fastener without an opening of said slot extending upwardly.

In an embodiment of the invention, hanging support members, configured as threaded fasteners extend horizontally inward from each of the frame side panel, at least one on each side panel, toward the opposite side panel, the horizontal bracket of the sleeper mechanism having a slot to engage the at least one threaded member. The slot in an embodiment having a overall y-shape, with an expanded mouth opening to initially receive and guide the threaded member during the horizontal placement motion of the sleeper mechanism into the open bottom of the sofa frame. In an embodiment the lower leg of the slot extends toward the foot end (front end) of the sleeper mechanism, such that the seating end of said slot is extending upwardly and such that the sleeper mechanism may be hung on the extending threaded member.

In an embodiment of the invention, once the sleeper mechanism is hung from the first original hanging support members on each side of the sofa frame, the sleeper mechanism is swung away from the workers, toward the top of the sofa frame to facilitate fastening of the mechanism to additional second original fasteners extending from the side frame members, such as screws, studs, or bolts. In an embodiment, the horizontal brackets on each side of the sleeper mechanism will have a slot, or recess extending from the bottom edge of the horizontal member to receive the second original support members. In embodiments the suspended sleeper mechanism is swung past the second original fasteners by manually deflecting the horizontal brackets inwardly toward the other respective horizontal bracket, or maneuvering the mechanism to move the bracket inwardly, and the suspended sleeper mechanism is then swung back toward the worker(s) to allow the slot or recess to engage with the second original support member, such as a threaded fastener.

In embodiments, the original primary support member and the original secondary support member may be conventional T nuts inbedded into the side panel member with bolts threaded therein and extending therefrom.

In an embodiment, the threated fasteners can be part of or attached to a bracket that is secured to the side panels. For example, a mortise can initially be cut into a side board on each side of the frame. A pair of brackets can be attached to each side board at the mortise and a pair of stud bolts can be extending from each bracket towards the open bottom of the frame. To install the sleeper mechanism, the frame can be laid on its back with the open bottom facing forwardly. The sleeper mechanism can be advanced towards the open bottom in its folded position. The stud bolts extending from the frame portion can be inserted through apertures facing the threaded members on the horizontal brackets of the sleeper mechanism. The sleeper mechanism can be affixed to the frame by tightening nuts over each stud bolt.

In another embodiment, installation of a sleeper mechanism into a frame of a sofa sleeper utilizes a bracket. Initially the frame is aligned such that an open bottom portion of the frame is upright and facing outwardly. The sleeper mechanism is then advanced towards the open bottom portion and hook apertures on the brackets are engaged with upper fasteners on the frame. The sleeper mechanism is then swung inwardly towards the top portion of the frame until notches on the bracket are passed by lower fasteners on the frame and then swung back towards the open bottom portion to engage the notches with the lower fasteners. The notches may be V-shaped. When the sofa is completed the V-shaped notches are inverted and facilitate support of the sleeper mechanism whether or not the lower fasteners are securely tightened, that is even if they loosen they still can carry the weight of the sleeper mechanism.

In a further embodiment, a sofa sleeper includes a frame and sleeper mechanism connected by a pair of brackets. Frame includes a top portion, an opposing bottom portion and an upper and a lower fastener disposed on each of an opposing pair of sides. Sleeper mechanism is disposed within the frame in a collapsed position. The brackets are connected to the sleeper mechanism with fasteners extending through a top slot and a bottom notch in each bracket. The top slots are hook shaped to capture the fasteners and secure their seating in the slot by gravity.

A feature and advantage of embodiments of the present invention is that installation of the sleeper mechanism into the frame can be done much more quickly and efficiently than with prior methods.

Another feature and advantage of embodiments of the present invention is that the sleeper mechanism can be more securely held within the frame. In some embodiments, even if the fasteners become loose, the sleeper mechanism will remain secured to the frame.

Another feature and advantage of embodiments of the present invention is a safer installation process. The elimination of the need to unfold and fold each sleeper mechanism eliminates that likelihood of pinching of body parts that comes with folding and unfolding the unit.

A feature and advantage of the invention is that the heavier fully dressed sofa frame does not need to be lifted or maneuvered during the sleeper mechanism to sofa frame install. A further feature and advantage of the invention is that once the sleeper mechanism is hung on the extending threaded fasteners, the workers can focus on the attachment procedures rather than on supporting the weight of the sleeper mechanism.

A feature and advantage of embodiments of the invention is that support fasteners are urged to seat in L-shaped slots during assembly by gravity.

A feature and advantage of embodiments of the invention is that the engagement of notches and the retention of the engagement of notches on the horizontal brackets of the sleeper mechanism with horizontal extending support fasteners is facilitated by gravity operating on the supported sleeper mechanism.

Another feature and advantage of embodiments of the present invention is that during the time that the workers are supporting the weight of the sleeper mechanism, the workers only need to guide the sleeper mechanism onto a pair of hanging members extending from the side panel members of the sofa frame, and that an expanded, such as a V-shape opening of a receiving slot on the horizontal mechanism facilitates and simplifies the guidance of the sleeper mechanism onto said hanging members.

DETAILED DESCRIPTION

Figure 1:
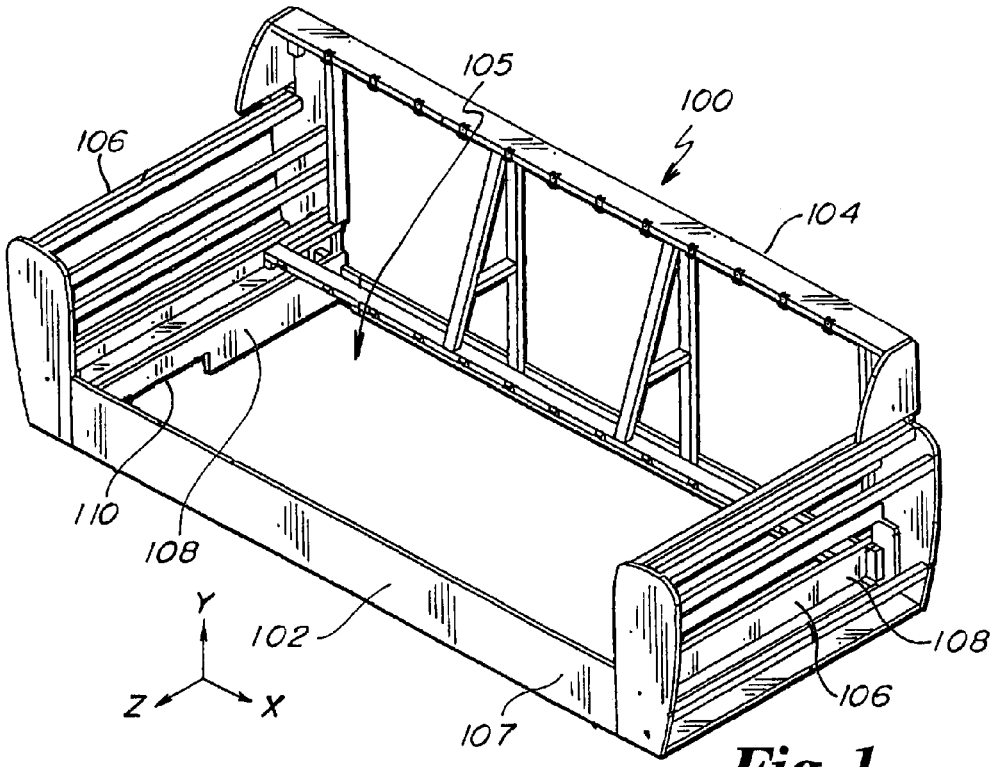
FIG. 1 is an isometric view of a sofa sleeper frame according to an embodiment of the present invention.
Figure 3:
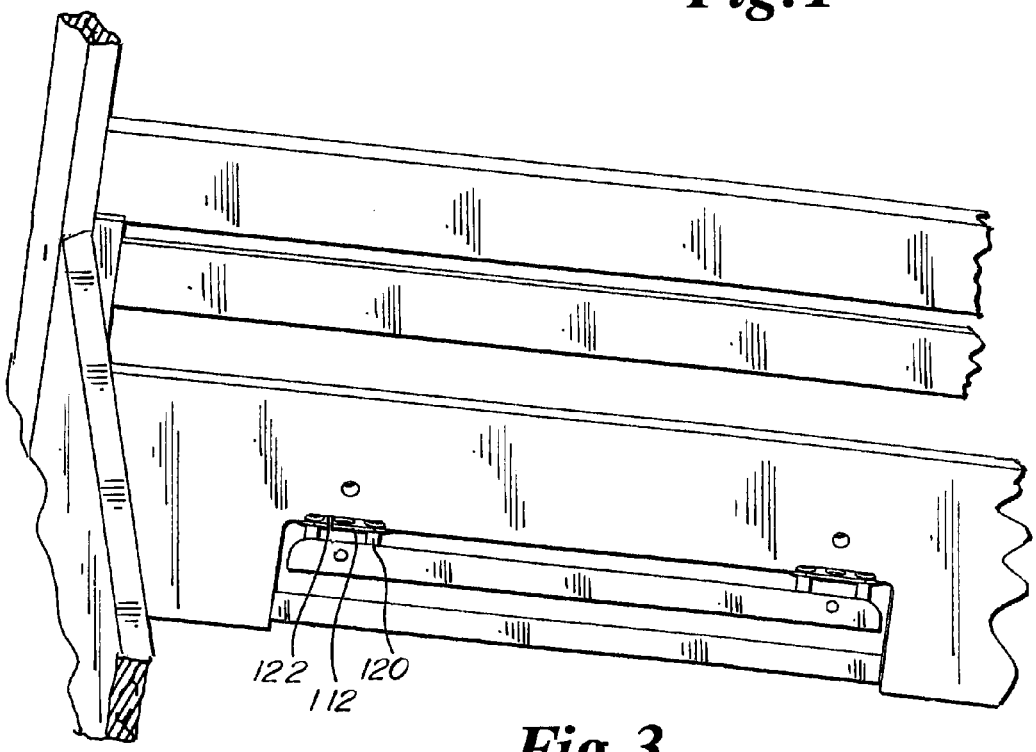
FIG. 3 is a partial view of the sofa sleeper frame of FIG. 1. The sleeper mechanism is not shown for clarity.
Figure 2:
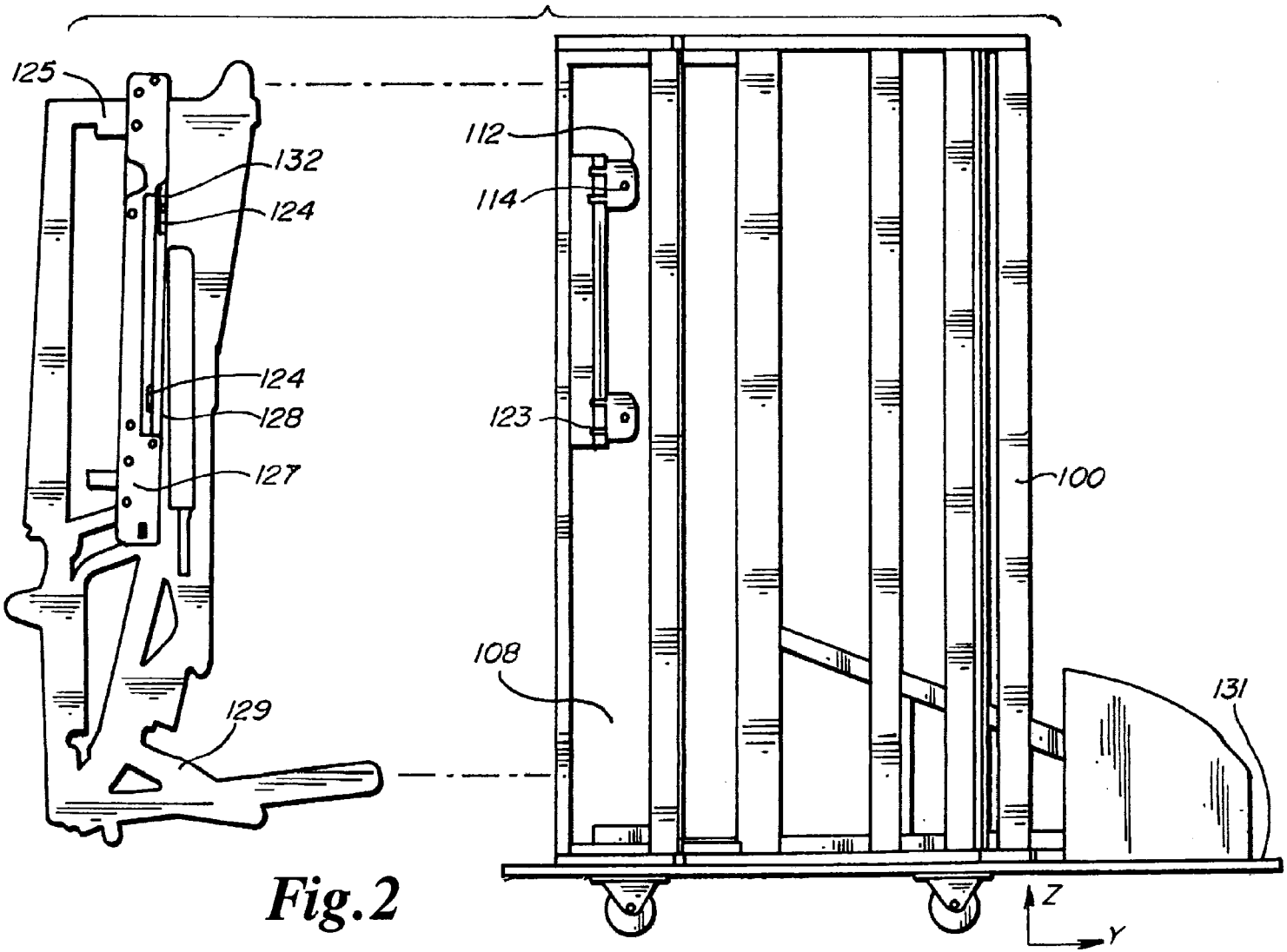
FIG. 2 is a side view of the sofa sleeper frame of FIG. 1 with brackets at the mortise, the sofa frame rotated 90 degrees on the sleeper mechanism ready for insertion.

Referring to FIG. 1, a sofa frame portion 100 of a sofa sleeper according to an embodiment of the present invention is illustrated. Sofa frame portion 100 includes a front 102, a back side 104, and a pair of sides. Sofa frame 100 can be comprised of wood or wood product and have an open bottom 105 at a base 107. Although the present disclosure describes the invention with regard to a sofa sleeper, it will be understood that the concepts described herein could be applied to any other type of furniture employing a foldable sleeper mechanism, such as, for example, a chair.

Referring to FIGS. 1-4, each side frame 106 of frame 100 can include a side panel 108 having a mortise 110. The mortise 110 can be created by cutting an opening into side panel 108. A pair of brackets 112 can be affixed to each side panel or board 108 at cutout or mortise 110. Bracket 112, as depicted more clearly in FIG. 4, can have a generally L-shaped body. Alternatively, bracket 112 can have various other shapes, such as, for example, a U-shape. Moreover a single bracket can be used on each side rather than two. Bracket can include an aperture 114 through an upper portion thereof that can be used to mount bracket to an outside surface of side board 108 with a complementary aperture 116 through side board 108. Bracket 112 can also include apertures 118 through a lower portion thereof that can be sized to accommodate studs or bolts 120. As shown in FIG. 3A, side board 108 can optionally include grooves 122 for accommodating the top of the studs or bolts 120. Alternatively, as shown in FIG. 3B, side board 108 can include recesses 122 for accommodating the studs or bolts 120. The bracket provides hanging support members 123 for suspending the sleeper mechanism 125.

An attachment piece 124 of a sleeper mechanism may be configured as an angle iron and attached to or made an integral part of the horizontal bracket 127 associated with sleeper mechanism 125. Such sleeper mechanisms have mattress support potions and linkages 129 that connect the horizontal bracket to the mattress support portions. The details of the sleeper mechanism will not be discussed in detail other than the horizontal bracket that is utilized to connect the sleeper mechanisms to sofa frames. Reference is made to U.S. Patent Publication No. 2008/0098518 for details of such a mechanism. The contents of said reference is incorporated by reference herein. Attachment pieces 124 are the portions of the sleeper mechanism that first come into contact with frame 100 while installing the sleeper mechanism and are used for affixing sleeper mechanism to frame 100. Attachment piece 124 can have a generally L-shaped body with an upper portion 126 and a lower portion 128. Upper portion 126 can include apertures 130 and lower portion 128 can include apertures 132. Apertures 130 in upper portion 126 can be used for securing to a horizontal bracket of a convention sleeper mechanism.

The manufacturing process of a sofa sleeper begins with the assembly of the frame 100. Assembly of the frame 100 can include cutting the mortises 110 into the side boards 108. At the time the frame 100 is assembled, the brackets 112 are affixed to the side boards 108 and the stud bolts 120 are inserted through apertures such that the project downwardly and into mortises 110. The studs may be welded to the bracket base or otherwise affixed. Upholstery or other coverings can then be added to the frame 100. After the upholstery is added, the sleeper mechanism can be installed.

To install the sleeper mechanism, the frame 100 is rested on its back frame 104, such as on a cart 131 or a table, with the open bottom facing outwardly towards the installer as depicted in FIG. 3C. The stud bolts 120 are therefore facing the installer as well. The sleeper mechanism is then moved substantially horizontally in the y direction towards the frame 100 in its folded position and the hanging support members 120 configured as threaded 120 members are inserted through the apertures 132 in lower portion 128 of attachment piece 124. The studs or bolts 120 ensure that the sleeper is in the proper position and temporarily support the weight of the sleeper. The sleeper is then secured to the frame by attaching four nuts to the four studs or bolts 122 on each side of the frame 100. This securely attaches the attachment piece 124 and the horizontal bracket 127 of the sleeper with the brackets 112 of the frame 100. The combined unit can then continue the assembly process or be prepped for sipment.

The above described process provides for installation of sleeper mechanisms into sofa sleepers much more quickly and safely than existing methods. The number of steps for installation is greatly decreased as the sleeper mechanism only needs to be put in place and four nuts tightened on each side. This greatly simplifies a process that heretofore has involved having to unfold and fold the sleeper mechanism and attach multiple bolts and/or screws in separate discrete steps. In addition, elimination of the need to unfold and refold the sleeper mechanism decreases the likelihood of injury due to pinching.

Figure 6:
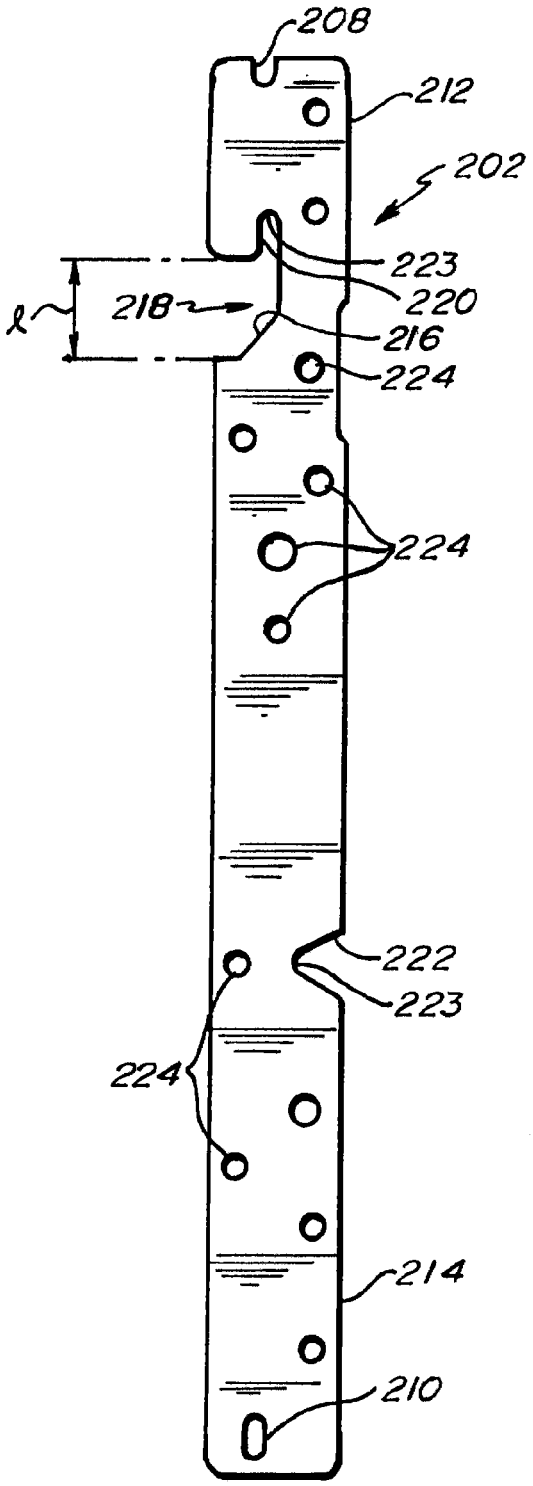
FIG. 6 is side elevational view of a horizontal bracket according to the embodiment of FIG. 4.
Figure 8:
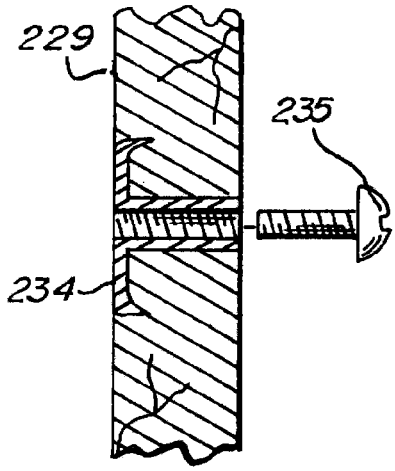
FIG. 8 is a cross-sectional view taken at line 8-8 of FIG. 5 and illustrating a primary hanging support configured as a t-nut and bolt.
Figure 4:
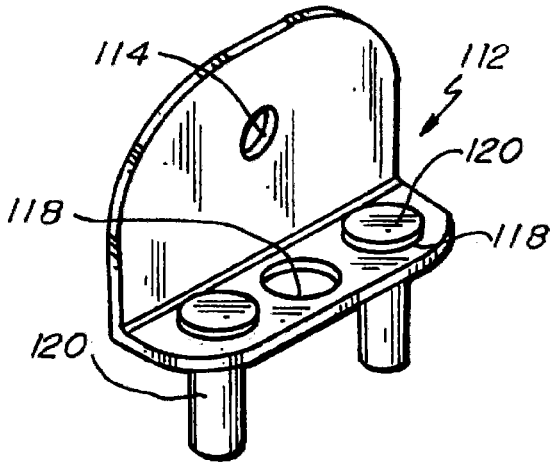
FIG. 4 is a side view of a different embodiment of a sofa sleeper frame and a sleeper mechanism ready for insertion into the open bottom of the base of the sofa frame.
Figure 5:
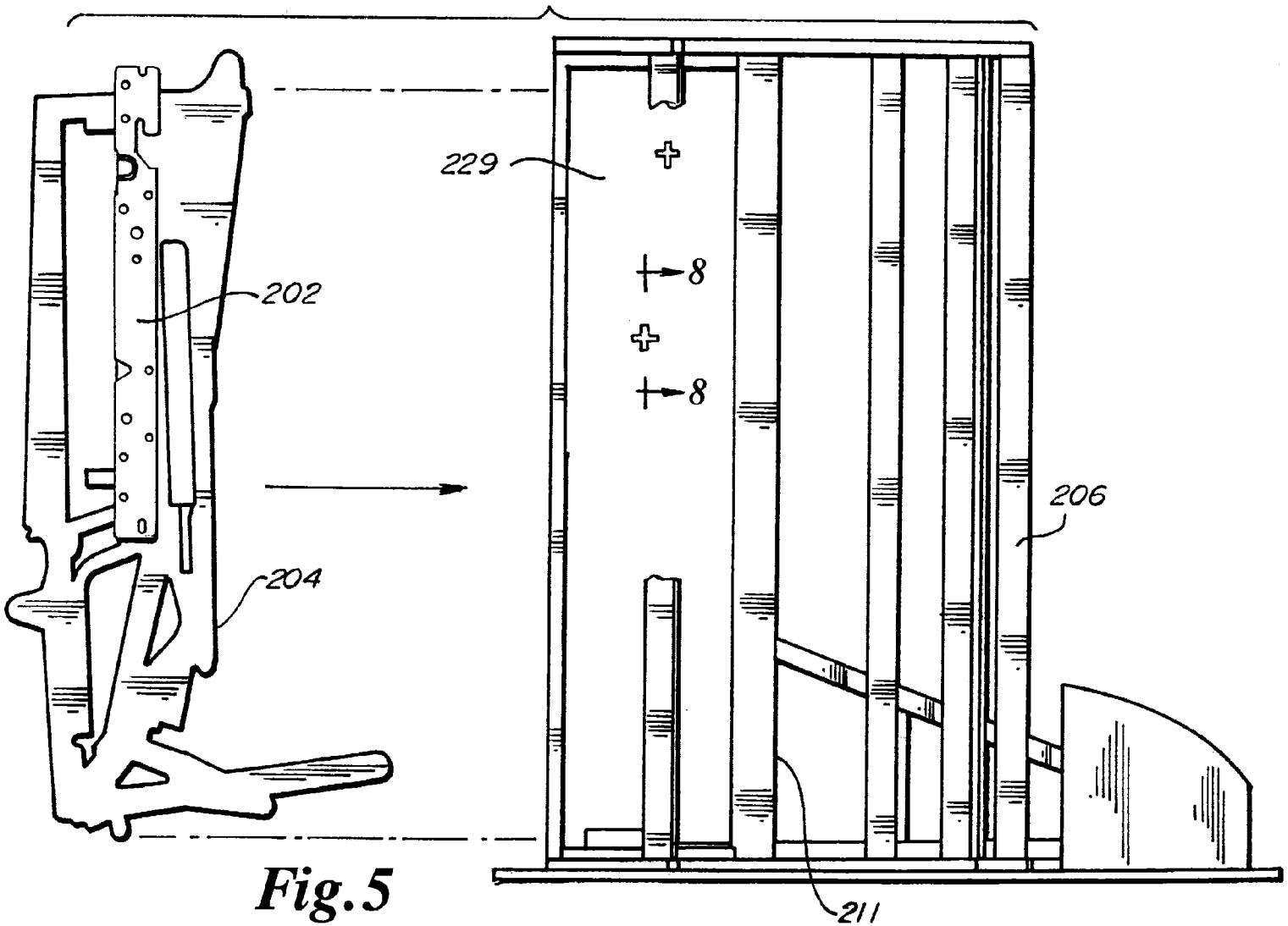
FIG. 5 is a detailed perspective view of a bracket shown in FIG. 2.
Figure 7:
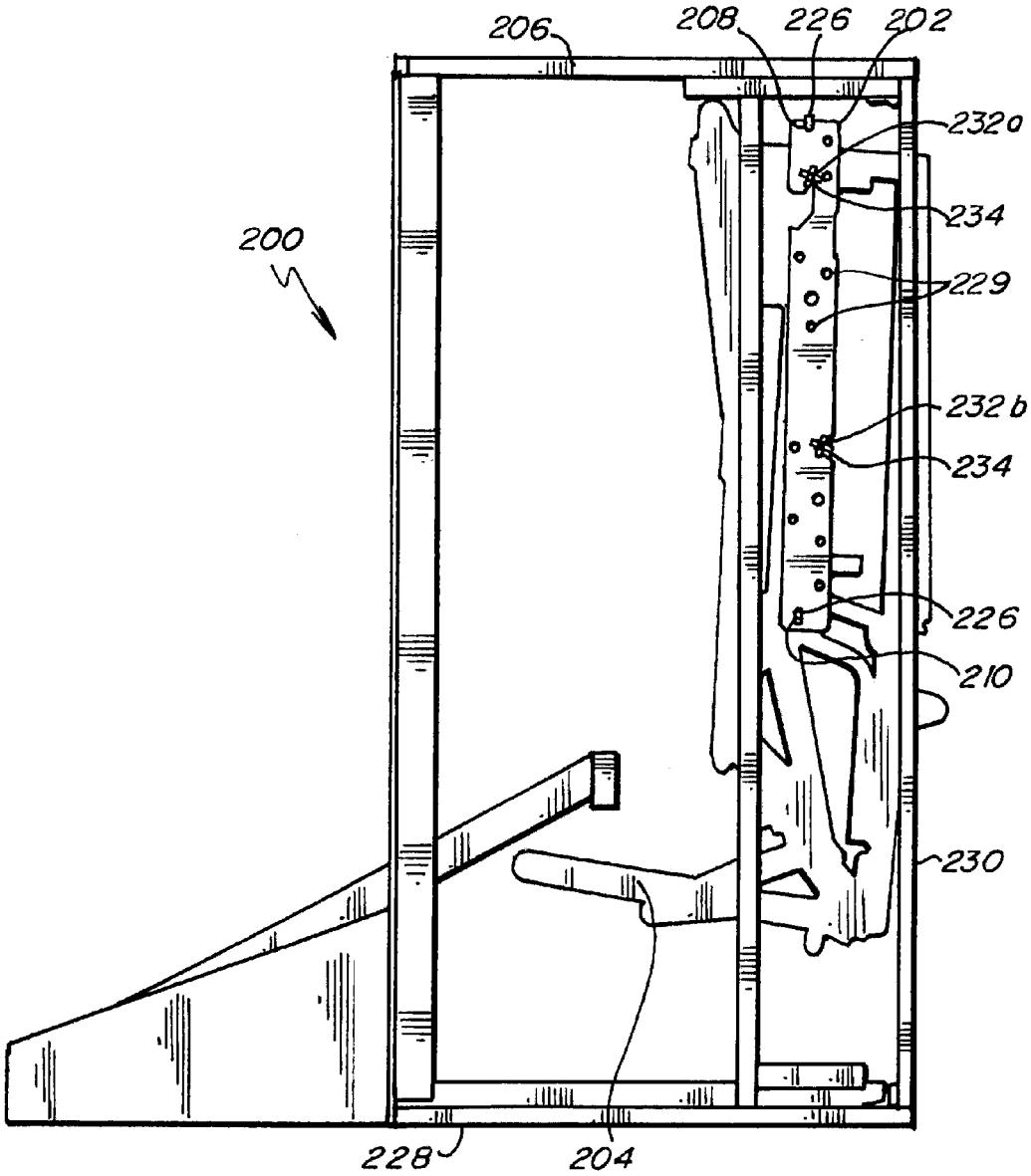
FIG. 7 is a side elevational view of a sleeper mechanism with the horizontal bracket of FIG. 6 installed in a sofa frame.

Referring now to FIGS. 5, 6, and 7, there can be seen a horizontal bracket 202 that is part of and can be used in mounting a sleeper mechanism 204 to a sofa frame 206 of a sofa sleeper 200 according to an embodiment of the present invention. In this view the horizontal bracket is vertical such as when the sleeper mechanism is being inserted into the sleeper mechanism cavity 211. In normal use the horizontal bracket will be horizontal. Horizontal bracket 202 can include a slot 208 intermediate the top edge 209 and bottom edge 212 of bracket 202 and a bottom notch or opening 222 at bottom edge 212 of bracket 202 for connection to a sleeper mechanism 204. Bracket 202 also includes a y-shaped slot 216 having a mouth or opening 218 along a top of bracket 202 and a recess 220. The length l of the mouth is preferable at least 1". In other embodiments at least ¾ of an inch. A notch 222 that, in some embodiments, is configured as a V-notch can also be defined at the lower edge 24 of bracket 202. In one embodiment, as depicted, L-shaped or hook slot 216 and V-notch 222 are on opposing edges of bracket 202. The slot has a seating portion 223 which engages the hanging support member extending from the sofa frame at the side panel 229. In other embodiments, hook aperture 216 and V-notch 222 can be presented on a common side of bracket 202. Bracket 202 can also include a plurality of other apertures 224 therethrough used to fasten supplemental fasteners 229 such as wood screws.

To install a sleeper mechanism 204 in a frame 206 of a sofa sleeper 200 with brackets 202, first a pair of horizontal brackets 202 is provided with sleeper mechanism 204. A pair of fasteners 232*a*, 232*b* are also extended through a side frame (not pictured for sake of clarity) of frame 206. In one embodiment, fasteners comprise a t-nut 234 inserted through side panel 229 and with a bolt 232 or screw extending inwardly from t-nut 234 toward the opposing side and threadably connected thereto. Such is a primary hanging member 235 for initial hanging of the sleeper mechanism. In various embodiments, the brackets 202 and fasteners 232 are preinstalled on the sleeper mechanism 204 and sofa frame 206, respectively.

Referring to FIGS. 5 and 7, to install the sleeper mechanism 204, the frame 206 is laid on its back 228 such that an open bottom 230 of the frame is oriented upwardly and outwardly. Note that FIG. 7 illustrates the t-nuts 234 which are imbedded into the side panel 229 of the sofa frame, but in this view the side panel is omitted.

The sleeper mechanism is moved substantially horizontally into the sleeper mechanism cavity 211. To connect sleeper mechanism 204 to frame 206, first the hook slots 216 on each side of sleeper mechanism 204 are mounted on fasteners 232*a* such that the fasteners 232*a* enter through openings 218 and engage bracket 202 at recesses 220 and seating portion 223. This can be most easily done by orienting the sleeper mechanism 204 at an angle relative to the frame portion 206. The relatively large openings 218 and inner perimeter of hook apertures 216 provides for significant alignment tolerance in mounting the hook apertures 216 onto fasteners 232*a*, which can allow both brackets 202 to easily be mounted simultaneously. This can be readily accomplished by a single installer. Because of the shape of hook slots 216, and orientation, upwardly, the sleeper mechanism 204 is now suspended from frame 206 without having to be supported or held in place by a user. The sleeper mechanism 204 and bracket 202 are then swung inwardly from the bottom 230 of frame 206 about hook apertures 216 and fasteners 232*a*, until V-notches 222 are further inward in frame 206 than the lower fasteners 232*b*. This also necessitates pushing the brackets 202 inwardly relative to the sides of frame 206 to provide a clearance allowing the brackets 202 to pass beyond the fasteners 232. The sleeper mechanism 204 is then swung back towards the bottom 230 of the frame 206 so that V-notches 222 engage lower fasteners 232*b*. This step can be done for the pair of brackets 202 either sequentially or simultaneously.

To complete the installation process, fasteners 232 can then be tightened to further secure the sleeper mechanism 204 in place on the frame 206. Additional supplemental fasteners, such as wood screws 229 can be attached thru apertures 224 into the sofa frame. Access to fasteners 232 for tightening can require partially opening the folded mattress of the sleeper mechanism 204, but does not require completely opening the unit as with many prior art units. In one embodiment, the sleeper mechanism 204 only needs to be opened three inches to allow sufficient access for tightening fasteners.

"Attached to" and "connected to" can have intermediate members to make the connection, such as a bracket or a portion of a fastener assembly, and need not be direct component to component engagement.

The invention has been described above with reference to several embodiments thereof. It will be apparent to those skilled in the art that alterations may be made in the embodiments described without departing from the scope of the invention. Thus, the scope of the present invention should not be limited by the embodiments described herein, but rather by the language of the claims and the equivalents of those structures.

The invention claimed is:

1. A method of manufacturing a sleeper sofa comprising:
assembling a sofa frame;
installing upholstery on the sofa frame;
tipping the sofa frame on its back so that an open bottom is exposed,
manually lifting and inserting in a generally horizontal motion a sleeper mechanism into the open bottom,
unloading the weight of the sleeper mechanism onto the sofa frame before securing fasteners between the sleeper mechanism and the sofa frame by hanging a pair of horizontal brackets of the sleeper mechanism onto a pair of protruding fasteners extending from respective pair of side panels of the sofa frame; and
fastening the horizontal brackets to the side panels of the sofa frame with a plurality of fasteners.

2. The method of claim 1 wherein each horizontal bracket has a slot with the interior end of the slot extending upwardly when the sleeper mechanism is being inserted in a generally horizontal motion, and wherein the method further comprising hanging the horizontal brackets onto the pair of protruding fasteners by engaging said protruding fasteners with said slots.

3. The method of claim 2 wherein said slots are on one edge of the horizontal brackets and the side panels have and additional pair of fasteners, one on each side panel, and the method further comprising engaging the additional pair of fasteners with the horizontal brackets on an edge opposite the edge having the slots.

4. A method of manufacturing a sleeper sofa comprising:
partially rotating a sofa frame so that an open bottom is upright and exposed,
manually lifting and inserting in a generally horizontal motion a sleeper mechanism into the open bottom,
unloading the weight of the sleeper mechanism onto the sofa frame by suspending the sleeper mechanism within the sofa frame at side panels of the sofa frame;
attaching the sleeper mechanism to the sofa frame after above step using fasteners between the side panels of the sofa frame and the sleeper mechanism.

5. The method of manufacturing of claim 4 wherein the partial rotation includes the step of rotating the sofa frame to rest on a back of the sofa frame.

6. The method of claim 4 wherein the step of unloading the weight of the sleeper mechanism onto the sofa frame includes the connecting slots extending from an edge of the horizontal brackets upwardly to protruding hanging members extending from side panels of the sofa frame.

* * * * *